US005823898A

United States Patent [19]

Wang

[11] Patent Number: 5,823,898

[45] Date of Patent: Oct. 20, 1998

[54] ASSEMBLY ADAPTED FOR USE BOTH AS A BASKETBALL BACKBOARD AND A BOXING TRAINING APPARATUS

[76] Inventor: Lian-Cheng Wang, No. 258-22, Hai Pin Road, Wu Lu Li, Ching Shui Chen, Taichung Hsien, Taiwan

[21] Appl. No.: 948,065

[22] Filed: Oct. 9, 1997

[51] Int. Cl.[6] ..... A63B 63/02

[52] U.S. Cl. ..... 473/483

[58] Field of Search ..... 473/472–489

[56] References Cited

U.S. PATENT DOCUMENTS

| | | | |
|---|---|---|---|
| 3,017,183 | 1/1962 | Chaloroff | 473/483 |
| 3,388,909 | 6/1968 | Woods | 473/472 |
| 3,716,234 | 2/1973 | Lancellotti | 473/481 |
| 3,841,631 | 10/1974 | Dolon | 473/481 |
| 3,881,724 | 5/1975 | Beveridge | 473/472 |
| 3,970,304 | 7/1976 | Ebstein | 473/481 |
| 4,546,973 | 10/1985 | Mouser | 473/472 |
| 5,050,866 | 9/1991 | Fucci | 473/483 |
| 5,556,088 | 9/1996 | Mower | 473/479 |

*Primary Examiner*—Theatruce Brown

*Attorney, Agent, or Firm*—Beveridge, DeGrandi, Weilacher & Young LLP

[57] ABSTRACT

A basketball backboard and boxing training apparatus including a base, a column, adjusting stem, first and second reeds and a boxing bag. The column has adjusting holes on opposite walls thereof. The first reed is inserted into a lower portion of the adjusting stem and any pair of the adjustment holes when the stem is fitted into the column. The backboard includes a ring and a suspension bolt disposed therein, and a mounting plate disposed at its bottom end. The suspension bolt can be driven into the backboard and is concealed when the apparatus is used as a basketball backboard. The second reed is inserted into and upper portion of the stem. Bolts are used to join the mounting plate of the backboard to the upper portion of the stem so that the apparatus can be used as a basketball backboard. The backboard can be turned to a horizontal position and the boxing bag can be suspended therefrom to make the apparatus usable as a boxing training apparatus.

2 Claims, 3 Drawing Sheets

ASSEMBLY ADAPTED FOR USE BOTH AS A BASKETBALL BACKBOARD AND A BOXING TRAINING APPARATUS

BACKGROUND OF THE INVENTION (a) Field of the Invention

The present invention relates to an assembly that can be adapted for use both as a basketball backboard assembly and a boxing training apparatus.

(b) Description of the Prior Art

In cities where living space is limited it is difficult to have a large yard for playing basketball. To satisfy children's need to play basketball, parents will buy portable or removable basketball backboards assemblies that can be erected in the house or in the open. There are also basketball backboards that are without support columns and can be fixed to the wall or door for shooting training. However, such backboards are hard to remove after they are fixed to the wall or the door and it is difficult to adjust their height to match a fast-growing child. Besides, they can only serve a single purpose. For children who want to play both basketball and boxing games, the parents have to buy two different training sets. It is therefore desirable to have an assembly that can serve both as a basketball backboard and a boxing training apparatus.

SUMMARY OF THE INVENTION

According to a first aspect of the present invention, the assembly adapted for use both as a basketball backboard and a boxing training apparatus comprises a base, a column, an adjusting stem, a backboard means, first and second reeds, and a boxing bag. The column has a threaded bottom section inserted into an insertion hole of the base and is provided with a plurality of adjustment holes on opposed walls thereof. The adjusting stem is inserted into the hollow interior of the column and can retractably displace therein. The first reed is inserted into a lower portion of the adjusting stem and has pivot pins that engage lower pivot pins of the adjusting stem and any pair of adjustment holes of the column when the adjusting stem is fitted into the column. The backboard means includes a backboard having a ring and a suspension bolt disposed thereon at suitable positions, and a mounting plate disposed at a bottom end. The suspension bolt can be driven deep into the backboard so that it is concealed when the assembly is used as a basketball backboard. The second reed is inserted into an upper portion of the adjusting stem. Bolts are used to join the mounting plate of the backboard means to the upper portion of the adjusting stem so that the assembly can be used as a basketball backboard. The backboard means can be turned downwardly by means of the mounting plate and changing the location of the bolts, and the boxing bag can be suspended on the suspension bolt to make the assembly a boxing training apparatus.

According to a second aspect of the present invention, the base has a hollow interior and is provided with a filler hole at an upper side. The filler hole is closable by a spigot. After assembly, water can be poured into the hollow interior of the base via the filler hole to give the base a sufficient weight to allow the base to stand firmly and stably on the ground. After assembly, the spigot can be removed to pour out the water to facilitate storage.

BRIEF DESCRIPTION OF THE DRAWINGS

The foregoing and other features and advantages of the present invention will be more clearly understood from the following detailed description and the accompanying drawings, in which.

FIG. 1A is a sectional view of the base and column of the assembly according to the present invention;

FIG. 1B is a schematic sectional view illustrating adjustment of the height of the assembly according to the present invention;

FIG. 4A is a sectional view illustrating adjustment of the angle of the mounting plate of the assembly of the present invention in turning the assembly into a boxing training apparatus.

DETAILED DESCRIPTION OF THE PREFERRED EMBODIMENT

Figure 1:
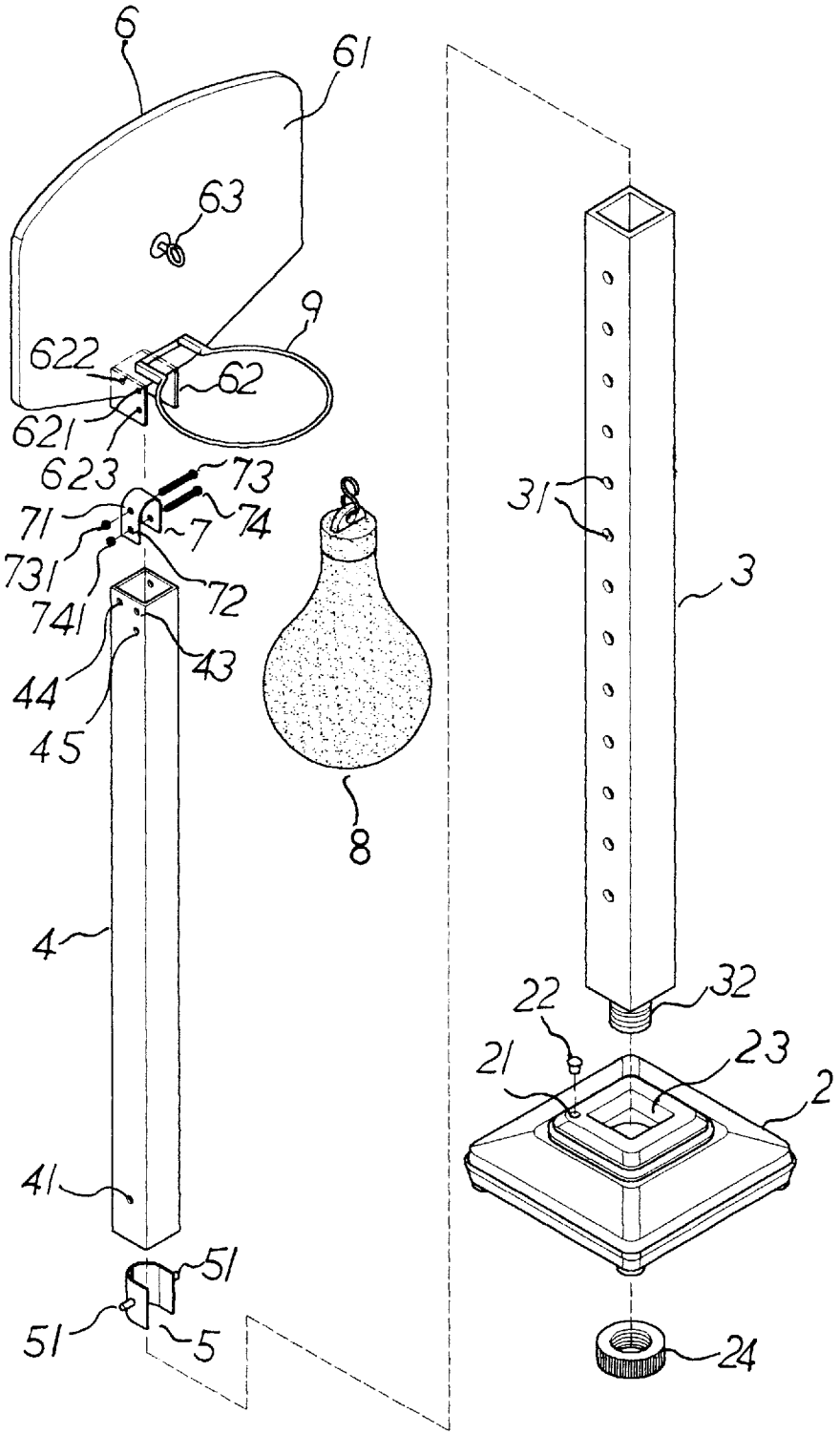
FIG. 1 is a perspective exploded view of the present invention.
Figure 2:
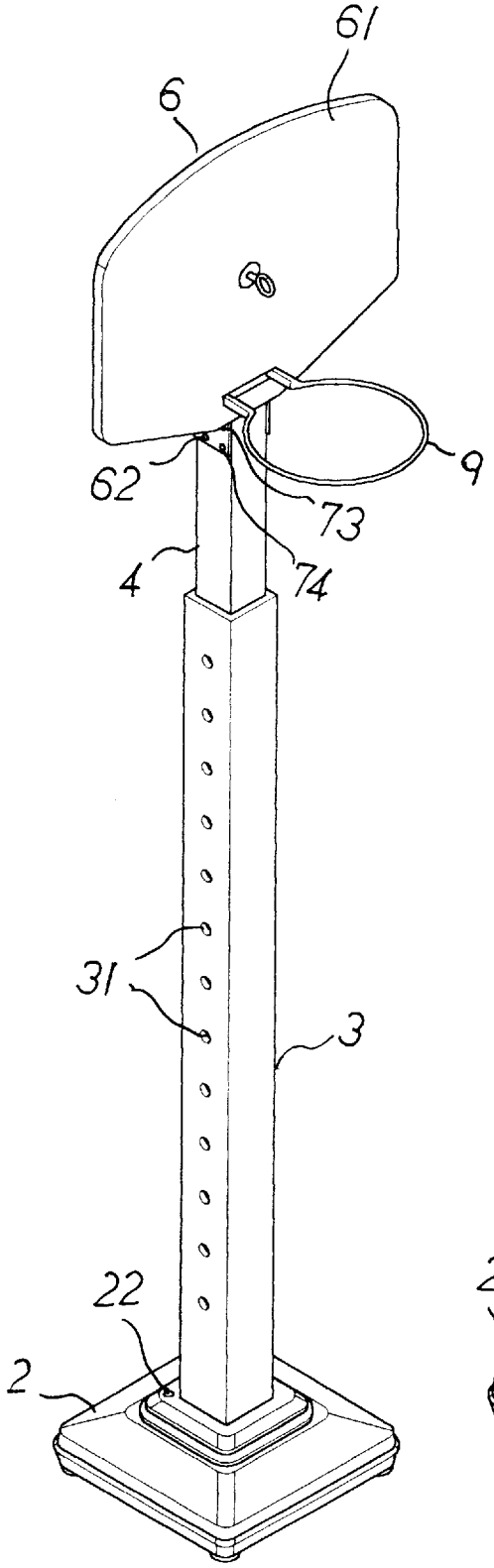
FIG. 2 is a perspective outer view of the present invention when used as a basketball backboard.

With reference to FIGS. 1 and 2, the present invention comprises a base 2, a column 3, an adjusting stem 4, a first reed 5 adapted for adjusting the height of the present invention, a backboard means 6, a second reed 6 adapted for adjusting the angle of the backboard means 6, a boxing bag 8, and a ring 9. The base 2 has a hollow interior and is provided with a filler hole 21 at an upper side which is stopped by a spigot 22. After assembly of the invention, the spigot 22 may be removed and water poured into the hollow interior of the base 2 via the filler hole 21 so that the base 2 becomes heavy and can stand stably and firmly on the ground. After use, the invention can be dismantled for storage, and the water in the base 2 can be discharged. The base 2 is further provided with an insertion hole 23 at a top end thereof, and a nut hole 25 at a bottom end thereof for receiving a nut 24, the nut hole 25 communicating with the insertion hole 23.

The column 3 is an upright hollow structure having a quadrilateral cross-section and is provided with a threaded section 32 at a bottom end thereof. The column 3 is inserted into the insertion hole 23 of the base 2 such that the threaded section 32 extends into the nut hole 25 below to screwably engage with the nut 24 (see FIG. 1A). The column 3 is further provided with a plurality of adjustment holes 31 in opposed walls thereof.

The adjusting stem 4 is an upright hollow structure with a quadrilateral cross-section such that it can be inserted into the interior of the column 3 and retractably displace therein. The adjusting stem 4 has lower pivot holes 41 at a lower portion thereof for engaging the first reed 5. An upper portion of the adjusting stem 4 is also provided with upper pivot holes 43. First locking holes 44 are disposed next to the upper pivot holes 43 at the same level and second locking holes 45 are disposed below the upper pivot holes 43 in an aligned fashion.

The first reed 5 is a substantially U-shaped structure that is received in the lower portion of the adjusting stem 4. The first reed 5 has pins 51 projecting from the outer surface thereof. The pins 51 engage the lower pivot holes 41 of the adjusting stem 4 and project from the lower pivot holes 41 after engagement. When the adjusting stem 4 is to be inserted into the column 3, the pins 51 may be pressed inwardly (see FIG. 1B) to allow the adjusting stem 41 to fit into the interior of the column 3. The pins 51 can engage any pair of adjustment holes 31 formed on opposed walls of the column depending on the desired height of the invention. It can therefore be seen that adjustment of the height of the invention is very simple and easy.

The backboard means 6 includes a backboard 61 to which the ring 9 may be assembled, a suspension bolt 63 screwably disposed in the backboard 6 at a suitable position for hanging the boxing bag 8, and a substantially U-shaped mounting plate 62 at a bottom end of the backboard means 6. The suspension bolt 63 can be driven deep inside the backboard 61 so that it is hidden therein when the present invention is used as a basketball backboard. The mounting plate 62 is provided with opposed pivot holes 621, first mounting holes 622 next to the pivot holes 621 at the same level, and second mounting holes 623 below the pivot holes 621 in an aligned manner.

The second reed 7 is substantially U-shaped and is received in the upper portion of the adjusting stem 4. The second reed 7 is provided with opposed upper through holes 71 and lower through holes 72. A first bolt 73 is passed through the pivot holes of the respective mounting plate 62 and the pivot holes 43 of the adjusting stem 4 as well as the upper through holes 71 of the second reed 7 and is locked in position using a first nut 731. A second bolt 74 is passed through the second mounting holes 623 of the mounting plate 62 and the second locking holes 45 of the adjusting stem 4 as well as the lower through holes 72 of the second reed 7 and is locked in position using a second nut 741 (see FIG. 4A). A basketball backboard as shown in FIG. 2 is thus assembled.

Figure 3:
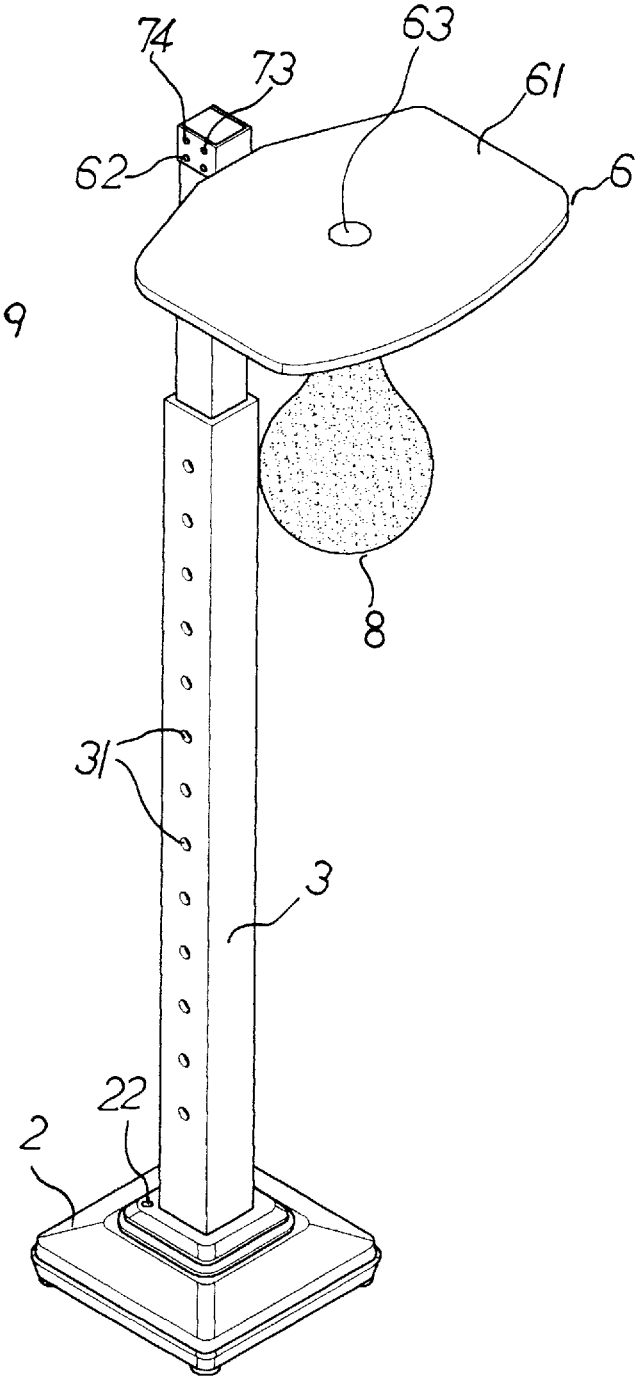
FIG. 3 is a perspective outer view of the present invention when used as a boxing training apparatus.
Figure 4:
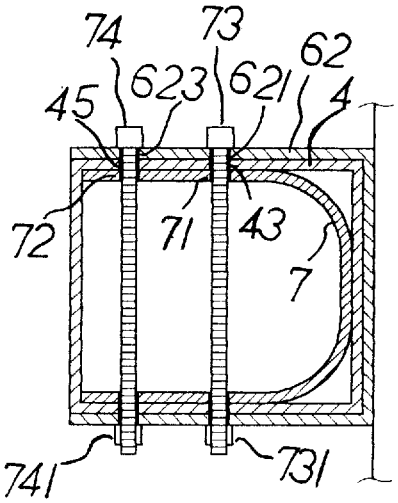
FIG. 4 is a schematic view illustrating the turning of the assembly into a boxing training apparatus.
Figure 4:
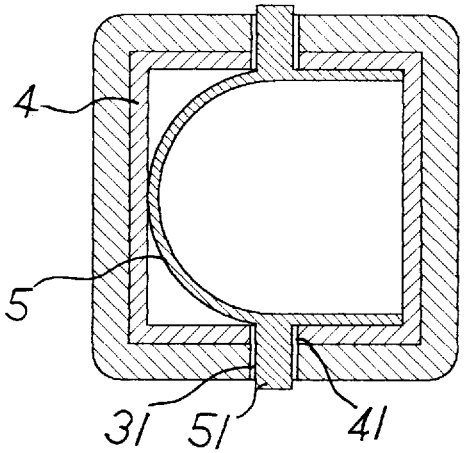
Figure 4:
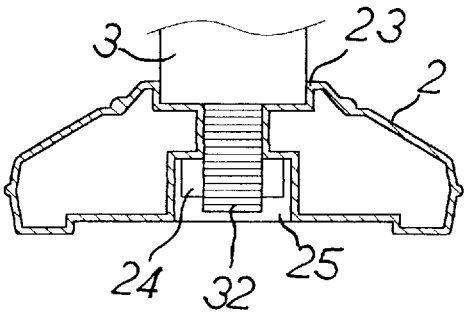
Figure 4:
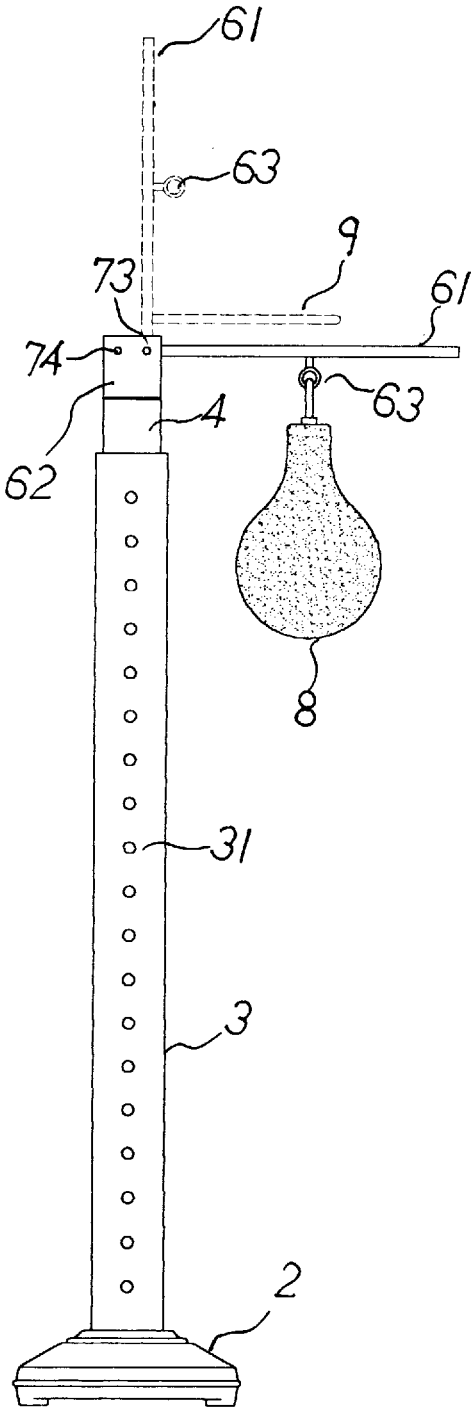

Referring to FIG. 4, when the present invention is to be used as a boxing training apparatus, the first bolt 73 is loosened (not removed) and the second bolt 74 is removed so that the first bolt 73 acts as a pivot. Then the backboard means 6 may be turned downwardly so that the second mounting holes 623 of the mounting plate 62 are aligned with the first locking holes 44 of the adjusting stem 4. Next the second bolt 74 is passed through the second mounting holes 623 of the mounting plate 62 through the first locking holes 44 of the adjusting stem 4 as well as the lower through holes 72 of the second reed 7 and is locked in position by the second nut 741. The first bolt 73 is then tightened. The suspension bolt 63 is then screwably pulled outwardly so that it projects from the backboard 61 for hanging the boxing bag 8, as shown in FIG. 3.

In summary, the present invention can be easily assembled to serve as a basketball backboard or a boxing training apparatus. The height of the invention is easily adjustable. Besides, the invention can be quickly dismantled to facilitate storage.

Although the present invention has been illustrated and described with reference to the preferred embodiment thereof, it should be understood that it is in no way limited to the details of such embodiment but is capable of numerous modifications within the scope of the appended claims.

What is claimed is:

1. An assembly adapted for use both as a basketball backboard and a boxing training apparatus, said assembly comprising:

a base, having an insertion hole at a top end, and a screw hole at a bottom end, said screw hole communicating with said insertion hole;

a column, being an upright hollow structure having a quadrilateral cross-section and insertable into said insertion hole of said base, said column having a threaded portion at a bottom end that, when said column is inserted with its bottom end into said insertion hole, extends through said insertion hole into said screw hole to engage a screw to lock said column on said base, said column further having a plurality of adjustment holes formed on opposed walls thereof;

an adjusting stem, being an upright hollow structure having a quadrilateral cross-section slightly smaller than the cross-section of said column such that said adjusting stem can be inserted into said column and can be retractably displace therein, said adjusting stem having opposed lower pivot holes formed at a lower portion thereof, opposed upper pivot holes formed at an upper portion thereof, first locking holes next to said upper pivot holes disposed at the same level as said upper pivot holes, and second locking holes disposed below said upper pivot holes in alignment therewith;

a first reed, being adapted for adjusting the height of said assembly and having a substantially U-shape, said first reed having pivot pins that engage said lower pivot holes of said adjusting stem when said first reed is inserted into the lower portion of said adjusting stem, said pivot pins projecting respectively from said lower pivot holes, said pivot holes also engaging any pair of adjustment holes of said column when said adjusting stem is inserted into said column so as to set the height of said assembly;

a backboard means, including a backboard, a ring mounted at a front side of said backboard, a suspension bolt embedded in said backboard at a suitable position, a substantially U-shaped mounting plate disposed at a bottom end of said backboard means, said mounting plate having opposed pivot holes, first mounting holes next to said pivot holes thereof at the same level, and second mounting holes below said pivot holes in alignment therewith;

a second reed, being adapted for adjusting the angle of said backboard means and having a substantially U-shape, said second reed having opposed upper through holes and lower through holes and being inserted into the upper portion of said adjusting stem;

a boxing bag, suspendable on said suspension bolt of said backboard means;

first and second bolts; and first and second nuts, whereby when said first bolt is passed through said pivot holes of said mounting plate, said upper pivot holes of said adjusting stem, and said upper through holes of said second reed and locked by said first nut, and when said second bolt is passed through said second mounting holes of said mounting plate, said second locking holes of said adjusting stem, and said lower through holes of said second reed and locked by said second nut, said assembly can be used as a basketball backboard; and when said second bolt is removed and said first bolt is loosened halfway so that it serves as a pivot point, said backboard means can be turned downwardly so that said second mounting holes of said mounting plate are brought into alignment with said first locking holes of said adjusting stem to allow said second bolt to pass through said second mounting holes of said mounting plate through said first locking holes of said adjusting stem and said lower through holes of said second reed and to be locked by second second bolt, so that said boxing bag can be suspended on said suspension bolt on said backboard to turn said assembly into a boxing apparatus.

2. An assembly as defined in claim 1, wherein said base has a hollow interior, a filler hole disposed at an upper side, and a spigot for stopping said filler hole, whereby water may be poured into the hollow interior of said base via said filler hole to give said base a sufficient weight so that said base may stand firmly and stably on the ground; the water may be poured out after use to facilitate storage.

* * * * *